United States Patent [19]

Muller et al.

[11] 4,164,287

[45] Aug. 14, 1979

[54] DISPLAY STAND AND ARRANGEMENT THEREOF

[75] Inventors: Jean A. Muller; Ray A. Shilling, both of Lancaster, Ohio

[73] Assignee: Anchor Hocking Corporation, Lancaster, Ohio

[21] Appl. No.: 851,442

[22] Filed: Nov. 14, 1977

Related U.S. Application Data

[62] Division of Ser. No. 709,101, Jul. 26, 1976.

[51] Int. Cl.[2] ..... A47F 5/11

[52] U.S. Cl. ..... 211/134; 108/111; 211/72; 211/186; 248/174

[58] Field of Search ..... 211/134, 135, 71, 72, 211/73, 186–188, 189; 248/174, 152, 459; 297/442; 108/101, 153, 156, 157, 159, 111

[56] References Cited

U.S. PATENT DOCUMENTS

| | | | |
|---|---|---|---|
| 1,886,532 | 11/1932 | Davidson | 248/174 X |
| 1,925,673 | 9/1933 | Potter | 248/174 X |
| 1,927,171 | 9/1933 | Horwath | 211/72 |
| 1,931,521 | 10/1933 | Ziemmerman | 248/174 X |
| 1,987,439 | 1/1935 | Froehlig | 211/72 X |
| 2,135,093 | 11/1938 | Abrams | 211/73 X |
| 2,430,166 | 11/1947 | Fish et al. | 248/174 X |
| 2,940,513 | 6/1960 | Holden | 297/442 |
| 3,120,826 | 2/1964 | Bowers et al. | 108/101 |

*Primary Examiner*—Roy D. Frazier
*Assistant Examiner*—Robert W. Gibson, Jr.
*Attorney, Agent, or Firm*—Holland, Armstrong, Wilkie & Previto

[57] ABSTRACT

A display stand for monogrammed articles which are arranged in a particular alphabetic pattern. The display stand has a plurality of shelves and upstanding standards. Floor supports interfit with the standards and the standards have slots which interfit with slots in the floor supports. The standards have a plurality of steps with at least one shelf formed by mounting a panel onto a step of the standard. The floor supports have a plurality of flaps which have slots therein which interfit with slots in the bottoms and sides of the standards. The floor supports also have inner flaps and outer flaps with the standards having vertical slots and horizontal slots so that the inner flaps of the floor supports interfit with the vertical slots and the outer flaps interfit with the horizontal slots.

13 Claims, 26 Drawing Figures

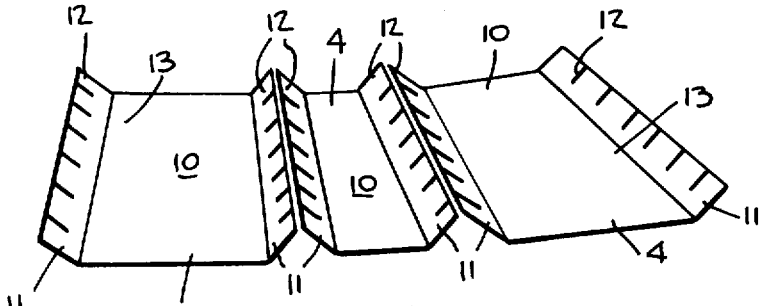
Fig. 2.
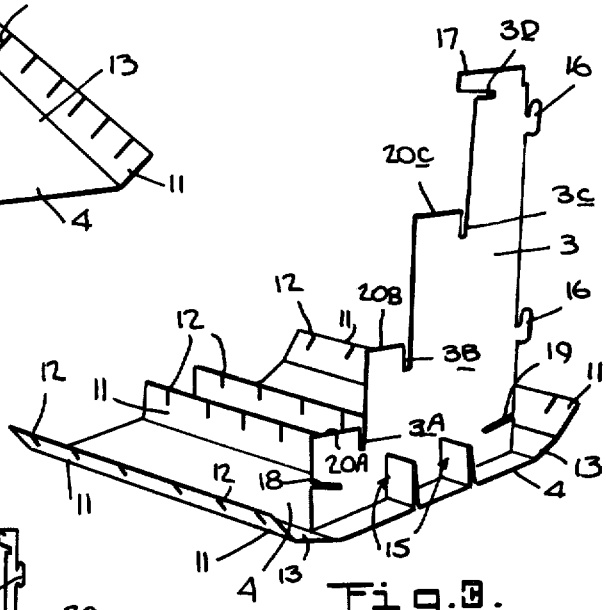
Fig. 3.
Fig. 4.
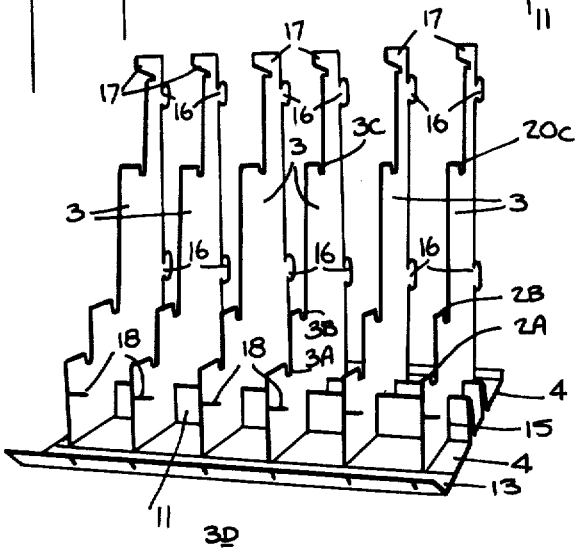
Fig. 5.
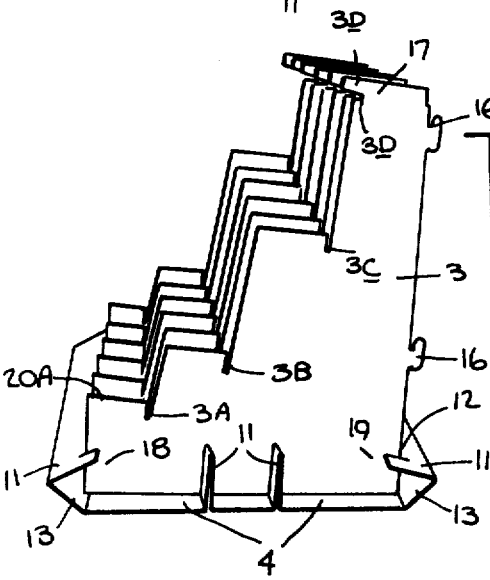
Fig. 6.
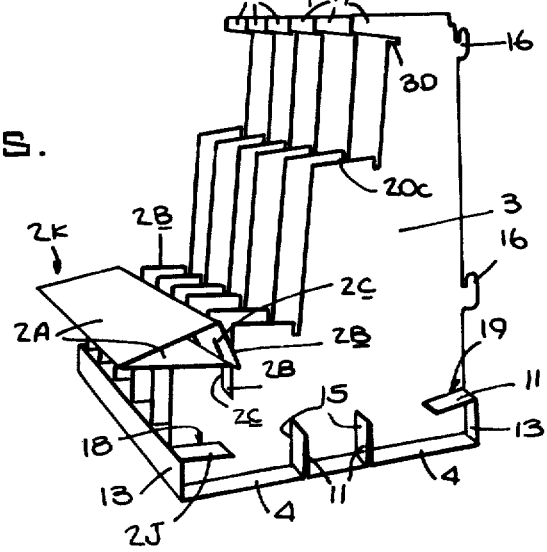

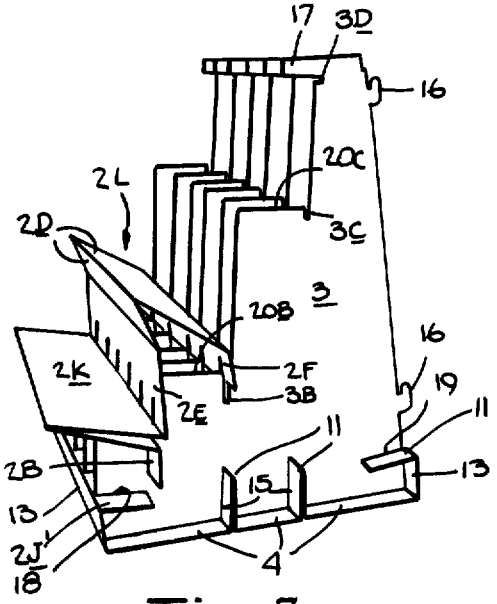
Fig. 7.
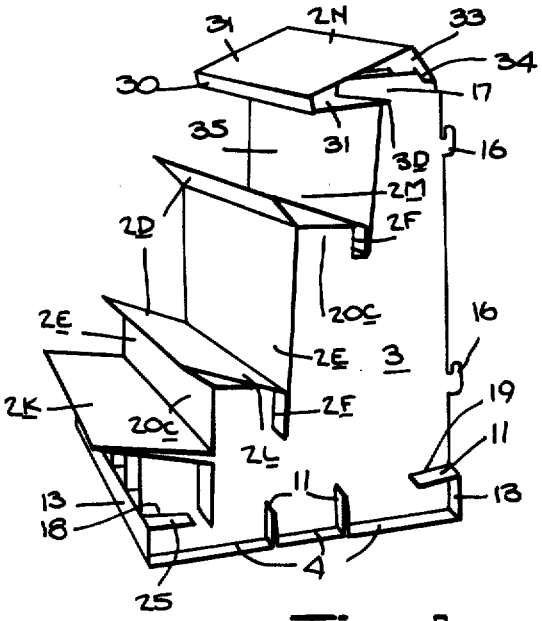
Fig. 8.
Fig. 9.
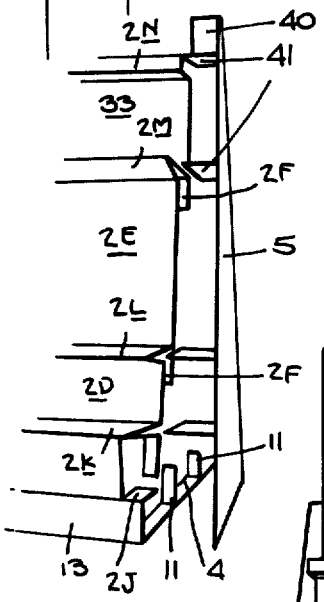
Fig. 10.
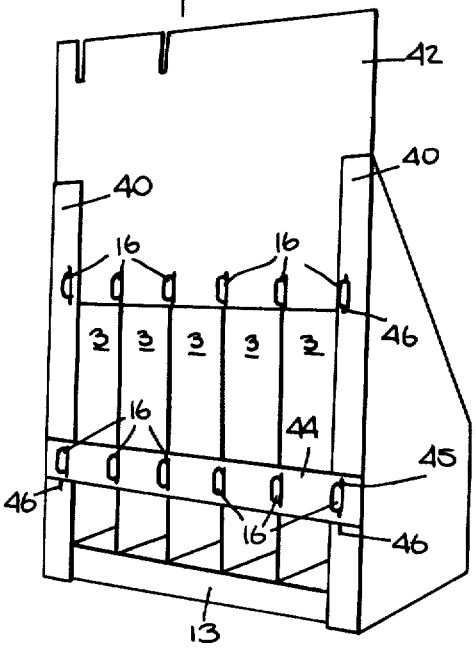
Fig. 11.
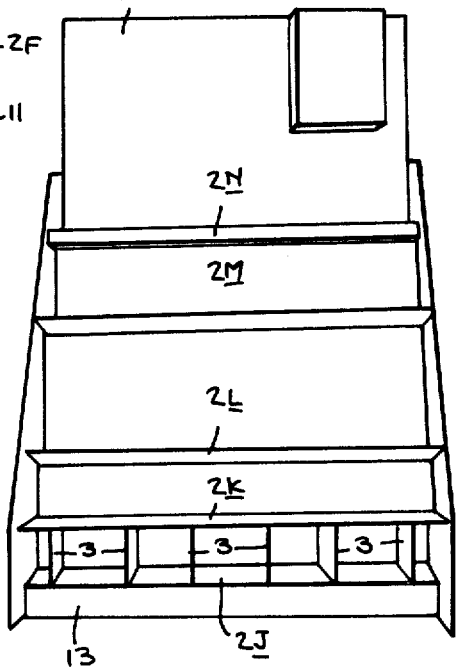

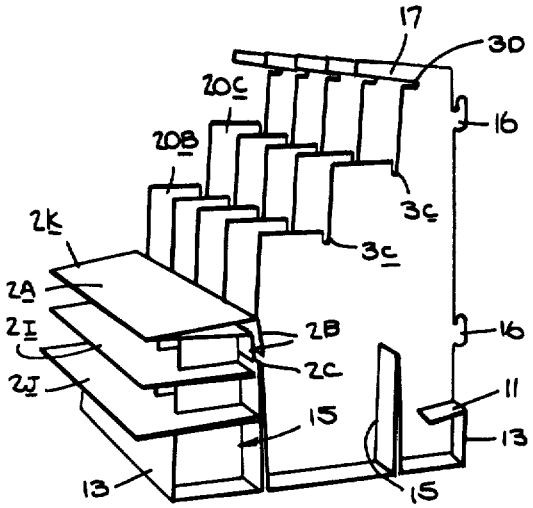
Fig. 20.
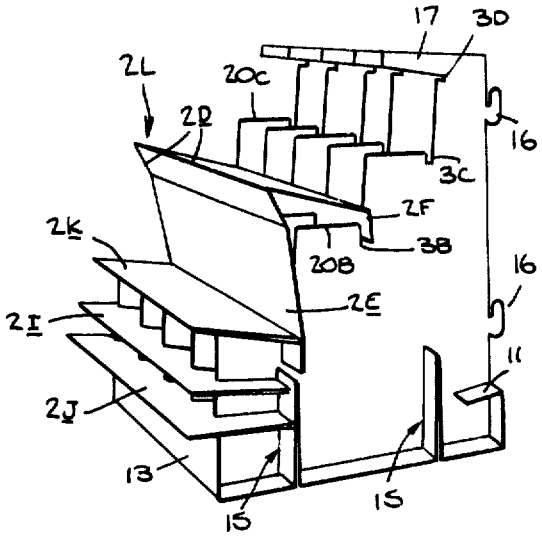
Fig. 21.
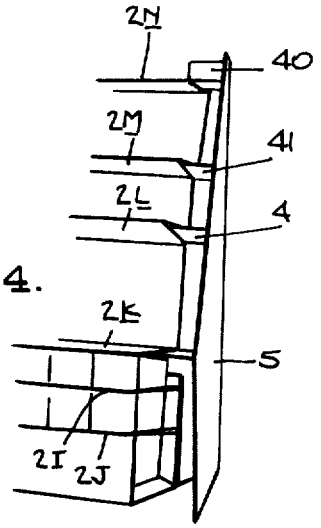
Fig. 24.
Fig. 22.
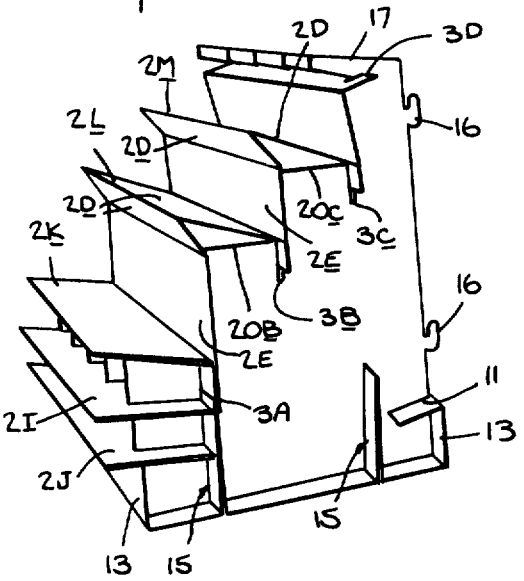
Fig. 23.
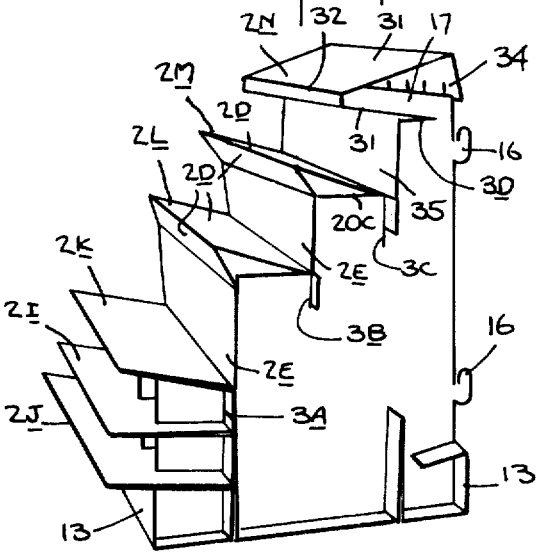

DISPLAY STAND AND ARRANGEMENT THEREOF

This application is a division of pending U.S. application Ser. No. 709,101, filed July 26, 1976.

DESCRIPTION

The present invention is directed to a display stand and particularly to a display stand adapted for displaying glass tumblers or similar articles which have monograms thereon or which are otherwise arranged alphabetically.

In displaying tumblers or other articles with monograms thereon, it has been found that certain letters of the alphabet are more commonly used than other letters of the alphabet. Hence, it facilitates the sale of the articles, as well as the availability of the article to the consumer, to have the letters displayed in a particular manner with the popular letters within easy reach of the consumer.

Furthermore, the more popular letters usually require more articles displayed since these articles will be used up faster than articles with other letters.

For example, it has been found that the letters B, C, H and M are more popular than the letters A and D. Hence, any effective display of such monogrammed articles should more prominantly display these articles and at the same time should provide users to use more articles with these letters which are within easy reach of the consumers.

The present invention has for one of its objects an improved display stand for displaying monogrammed articles, such as glassware, which will display such glassware in a particular arrangement with the more popular letters within easy reach of and in greater numbers than other letters to satisfy the demand thereof.

Another object of the present invention is an improved display stand wherein adequate shelving is provided for the articles to be displayed.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 2 is a perspective view showing one step of assembling the display stand.

FIG. 3 is a perspective view showing another step in the process of assembling the display stand.

FIG. 4 is a perspective view showing the next step in the assembly of the stand.

FIG. 5 is a perspective view showing the assembly of the bottom panel.

FIG. 6 is a perspective view showing the assembly of the shelves.

FIG. 7 is a perspective view showing a further assembly of the shelves.

FIG. 8 is a perspective view showing the top portion being assembled.

FIG. 9 is a fragmentary perspective view showing the sides being assembled.

FIG. 10 is a rear perspective view of the display stand.

FIG. 11 is a front elevational view showing the completed display stand before the articles are assembled thereon.

FIG. 20 is a perspective view showing another step.

FIG. 21 is a perspective view of still another step.

FIG. 22 is a perspective of another step in the process.

FIG. 23 is a perspective view of another step in the method.

FIG. 24 is a fragmentary view showing the sides being assembled.

Figure 1:
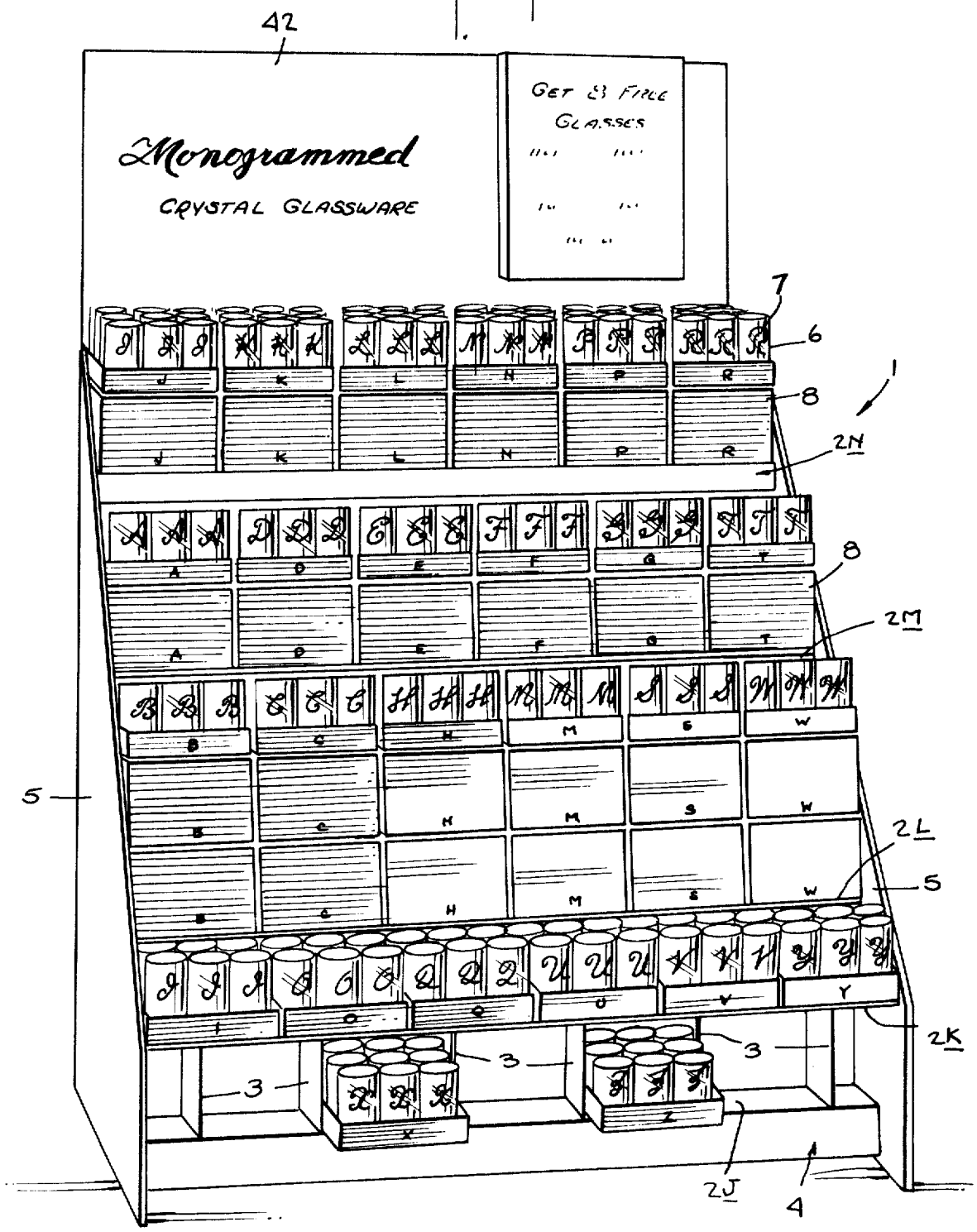
FIG. 1 is a perspective view of a display stand assembled with the articles mounted thereon made in accordance with the present invention.
Figure 25:
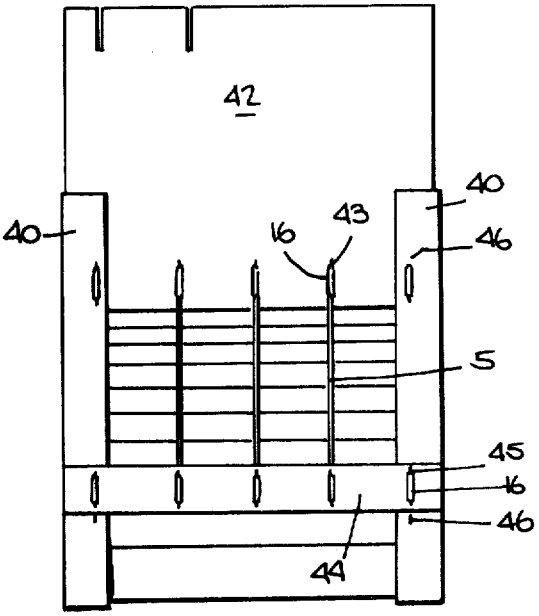
FIG. 25 is a rear perspective view of the display stand.
Figure 26:
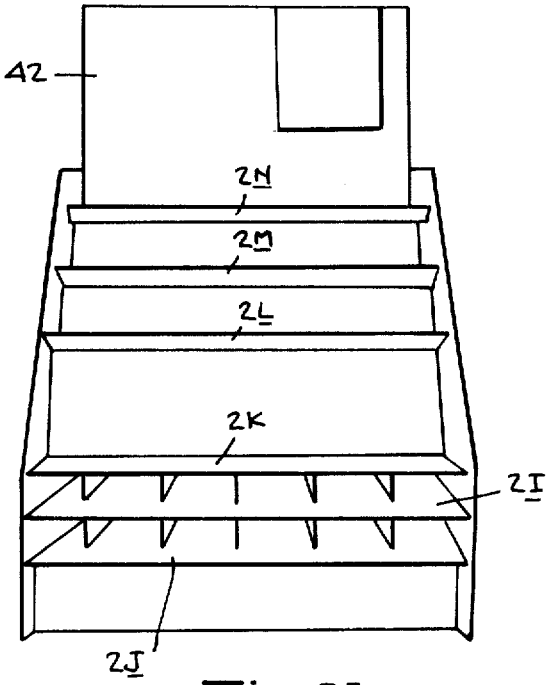
FIG. 26 is a front elevational view showing the completed display stand before the articles are assembled thereon.
Figure 12:
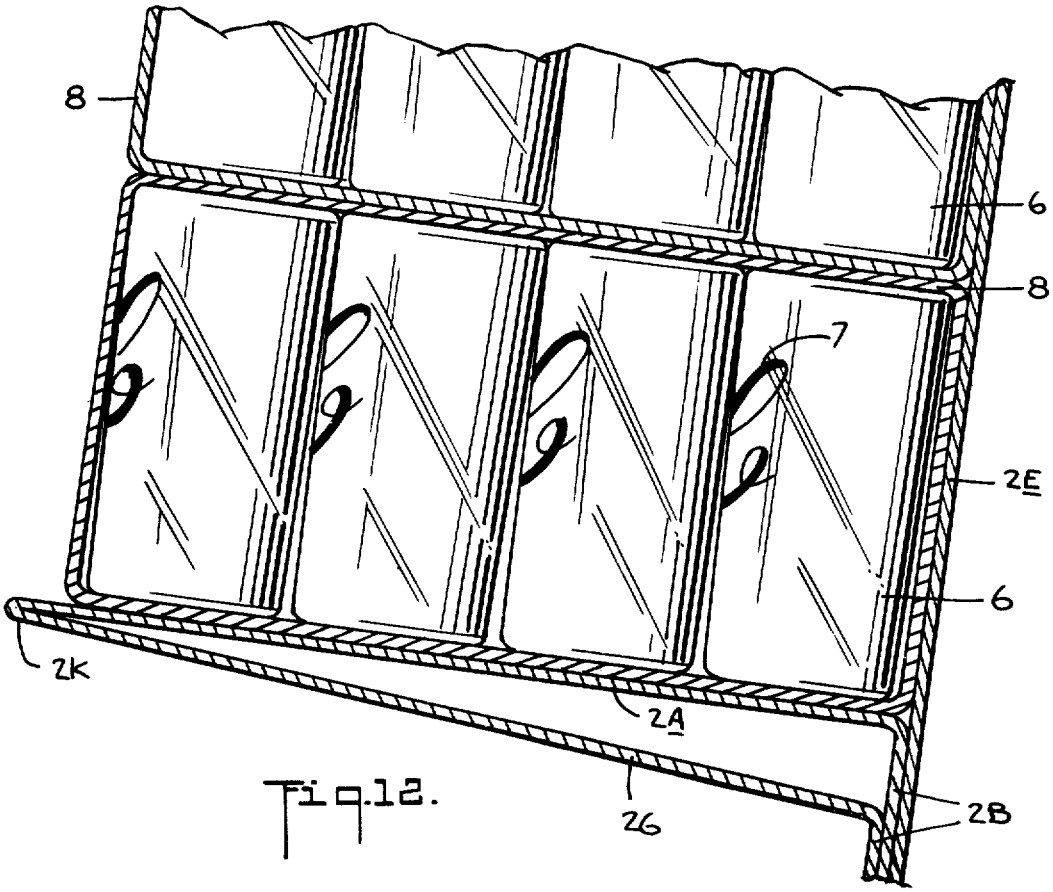
FIG. 12 is a sectional detail showing the articles in position on shelves.

Referring to the drawings, the display stand 1 of the present invention comprises a plurality of shelves 2I, 2K, 2L, 2M and 2N mounted on standards 3 which are held together in upstanding position by a plurality of floor supports 4. Side panels 5 are mounted on each side of the shelves 2I to 2N.

In the embodiment shown in FIG. 1, the articles 6 with the monograms 7 thereon are shown as comprising a plurality of tumblers packaged in cartons 8 which may also have the same letters monograms displayed on the outside. The top wall of the cartons 8 may be cut away to expose the tumblers 6 monograms 7 thereon.

The cartons 8 are stacked on the shelves 2J to 2N in a particular manner which depends on the popularity of the letters. For example, in FIG. 1, the more popular letters are the letters B, C, H, M, S and W. Three stacked cartons 8 of articles with these letters are shown on shelf 2L. These letters represent the more popular letters.

Resting on the shelf 2M above shelf 2L are a double layer of cartons which have articles with the letters A, D, E, F, G and T thereon. The top shelf 2N has a double layer of cartons for the letters J, K, L, N, P and R.

On the shelf 2K is a single layer of cartons 8 which include tumblers with the letters I, O, Q, U, V and Y therein. Finally, on the lowermost shelf 2I is a single layer of cartons 8 for the letters X and Z.

In this embodiment, the more popular letters are B, C, H, M, S and W. Three cartons 8 of each of these letters is stacked on this shelf 2L. This shelf 2L is located at its most convenient location. The letters are preferably arranged in alphabetical order from left to right. The second most popular group of letters are on the top two shelves 2M and 2N where double layers of the letters A, D, E, F, G and T arranged in that order are located on shelf 2M and the letters J, K, L, N, P and R are arranged on the topmost shelf 2N.

Below the shelf 2L is a single shelf 2K for the letters I, O, Q, U, V and Y which indicates a third group of popularity. The lowermost shelf 2I which represents the least popular letters has two single cartons of glassware with the letters X and Z thereon. It will be noted that the lowermost shelf 2I has some extra space which may be used to store extra cartons of articles.

The assembly of the display stand 1 shown in FIG. 1 is shown in FIGS. 2 through 12 and comprises a plurality of floor supports 4 which are placed adjacent to each other. The floor supports 4 each have a main panel 10 with flaps 11 extending from each longitudinal edge and having gripping slots 12 therein. In addition the rear and front floor supports 4 are provided with end panels 13.

The gripping slots 12 of each support 4 are placed in co-extensive alignment with each other and with flaps 11 adjacent to each other (FIG. 2). Standards 3 having bottom slots 15 are interfitted with each of the slots 12 in bottom supports 4 to hold the bottom supports 4 together and the standard upright. Each upright 3 is provided with rearwardly extending upper and lower tongues 16, a forwardly extending upper nose portion 17, front and rear slots 18 and 19, and steps 20A, 20B and 20C. The slots 12 of the rear and front flaps 11 are inserted into the slots 18 and 19 as shown in FIG. 5, with the front flap forming the shelf 2J.

Shelf 2K comprises folded panels 2A flaps 2B and slots 2C which overlies step 20A with slots 2C interlocking with the slots 3A behind step 20A. The second and third shelves 2L and 2M comprise folded panels 2D overlying steps 20B and 20C with front flaps 2E inserted into slots 3A and 3B, respectively, and rear flap 2F inserted into slots 3B and 3C, respectively. The top shelf 2N is formed by front panel 32 and folded panels 31 with lower panel 31 inserted into slot 3D and the slots 34 interfitting with the rear of the nose 17. A front cover 35 is also provided with its upper end in slot 3D and its lower end in slot 3C.

The side walls 5 are then assembled with a rear support panel 40 bent at right angles thereto and vertically supports 41 are inserted between the panels from the shelves 2K to 2N.

A top display panel 42 has lower slots 43 inserted on top tongues 16 and in front of the right angled support flaps 40 and a lower rear support strap 44 has its slots 45 inserted on the lower tongues 16. The flaps 40 have slots 46 which have both top and bottom tongues 16 inserted therein. With this construction, the articles are assembled on the various shelves in the manner outlined above.

Figure 13:
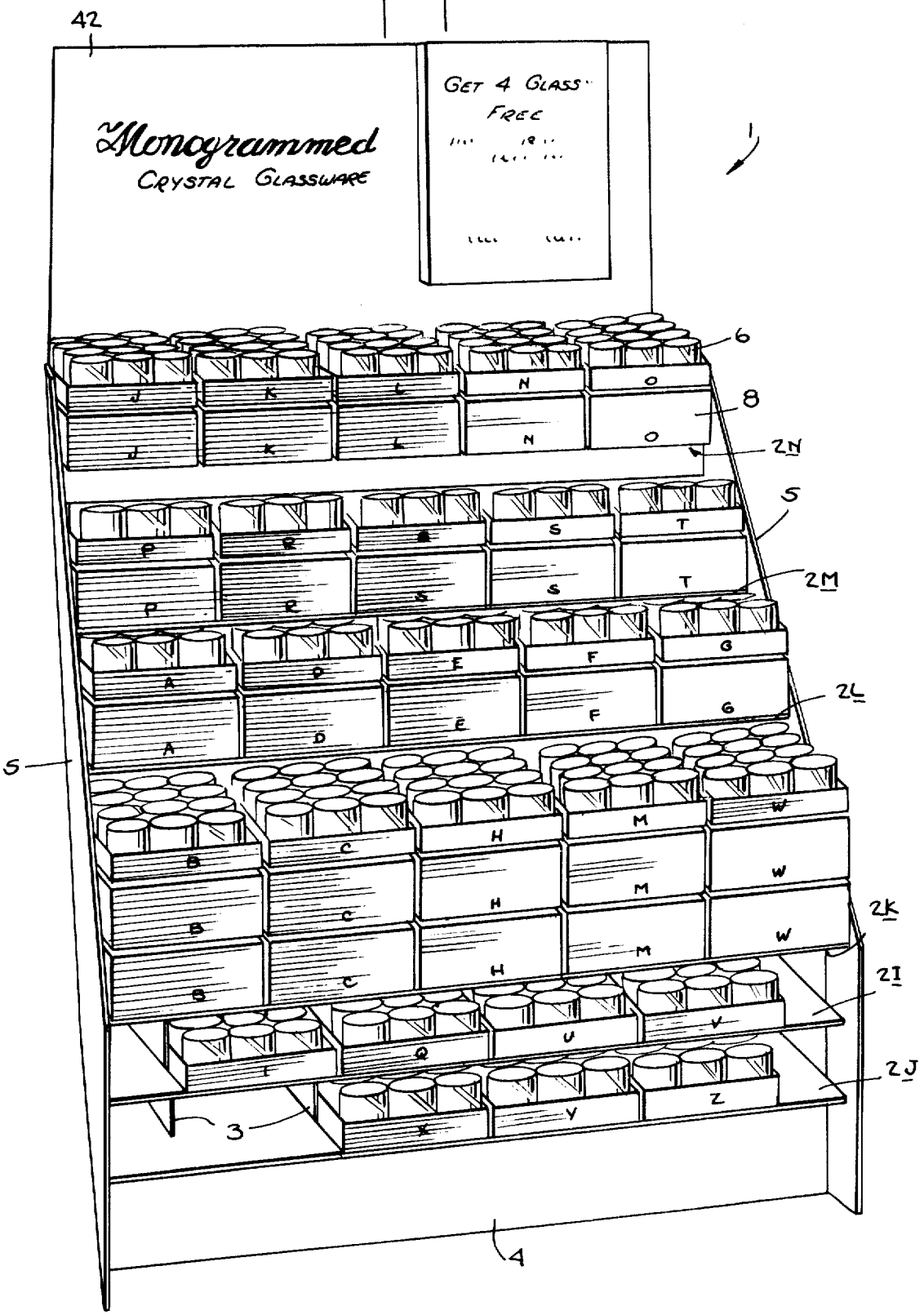
FIG. 13 is a perspective view of another embodiment of a display stand made in accordance with the present invention.
Figure 14:
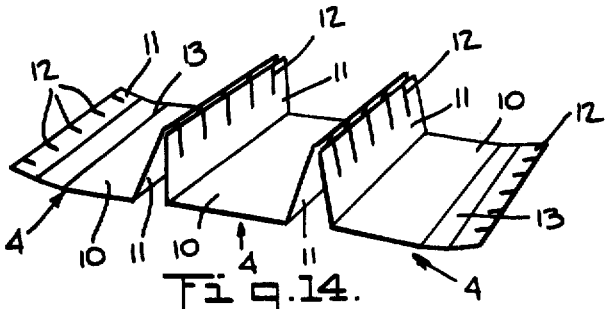
FIG. 14 is a perspective view showing a first step in the assembly of the modified display stand.
Figure 15:
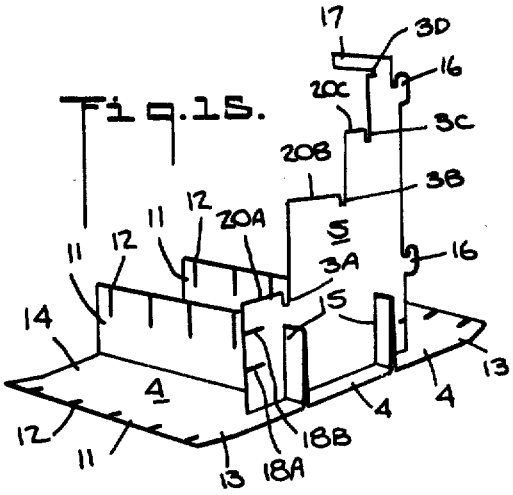
FIG. 15 is a perspective view showing another step.
Figure 16:
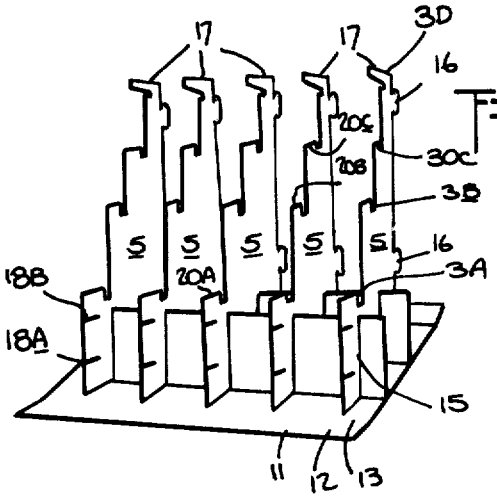
FIG. 16 is a perspective view showing the next step.
Figure 17:
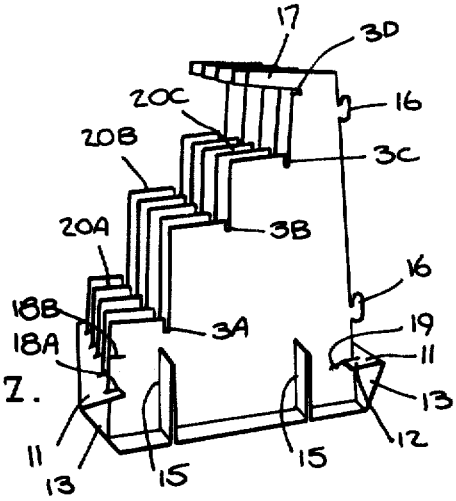
FIG. 17 is a perspective view showing the assembly of the bottom panel.
Figure 18:
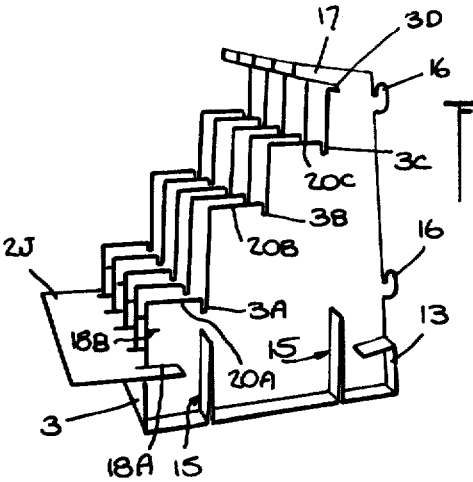
FIG. 18 is a perspective view showing the assembly of the shelves.
Figure 19:
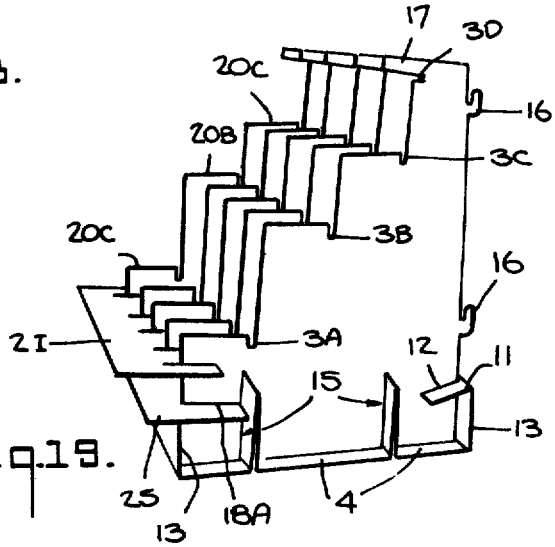
FIG. 19 is a perspective view showing a further assembly of the shelves.

The modification in FIG. 13 is directed to a slightly different configuration and is adapted to accommodate tumblers or articles 8 of smaller height. On the shelf 2K with the most popular letters, three cartons 6 for the letters B, C, H, M and W are stacked in superimposed relationship to each other. The shelf 2L are stacked with a double layer of cartons with the letters A, D, E, F, and G. The letters J, K, L, N and O are in double layers of cartons on the top shelf 2N. On the shelf 2L the letters P, R and T are located in double layers and two columns of double layer S article cartons are located. In the lowermost shelves 2I and 2J are located, respectively, the letters I, Q, U and V and the letters X, Y and Z in single layers.

The assembly of the display stand 1 shown in FIG. 13 is shown in FIGS. 14 through 26 and is similar to that shown in FIGS. 2 to 12. It comprises a plurality of floor supports 4 which are placed adjacent to each other. The floor supports 4 each have a main panel 10 with flaps 11 extending from each longitudinal edge and having gripping slots 12 therein. In addition the rear and front floor supports 4 are provided with end panels 13.

The gripping slots 12 of each support 4 are placed in co-extensive alignment with each other and with flaps 11 adjacent to each other (FIG. 2). Standards 3 having bottom slots 15 are interfitted with each of the slots 12 in bottom supports 4 to hold the bottom supports 4 together and the standard upright. Each upright 3 is provided with rearwardly extending upper and lower tongues 16, a forwardly extending upper nose portion 17, upper and lower front slots 18 and 18B, rear slots 19, and steps 20A, 20B and 20C. The slots 12 of the rear and front flaps 11 are inserted into the slots 18A and 19 as shown in FIG. 5, with the front flap 11 forming a support for the shelf 2J which is also inserted into slot 18A.

Shelf 2K comprises folded panels 2A flaps 2B and slots 2C which overlies step 20A with slots 2C interlocking with the slots 3A behind step 20A. The second and third shelves 2L and 2M comprise folded panels 2D overlying steps 20B and 20C with front flaps 2E inserted into slots 3A and 3B, respectively, and rear flap 2F inserted into slots 3B and 3C, respectively. The top shelf 2N is formed by front panel 32 and folded panels 31, with lower panel 31 inserted into slot 3D and the slots 34 interfitting with the rear of the nose 17. A front cover 35 is also provided with its upper end in slot 3D and its lower end in slot 3C.

The shelf 2I is formed by inserting a panel into slots 18B.

The side walls 5 are then assembled with a rear support panel 40 bent at right angles thereto and vertically supports 41 are inserted between the panels from the shelves 2K to 2N.

A top display panel 42 has lower slots 43 inserted on top tongues 16 and in front of the right angled support flaps 40 and a lower rear support strap 44 has its slots 45 inserted on the lower tongues 16. The flaps 40 have slots 46 which have both top and bottom tongues 16 inserted therein.

It will thus be seen that the present invention provided an improved display stand for displaying monogrammed articles, such as glassware, which will display such glassware in a particular arrangement with the more popular letters within easy reach of and in greater numbers than other letters to satisfy the demand thereof and wherein adequate shelving is provided for the articles to be displayed.

What is claimed is:

1. A display stand comprising a plurality of shelves and upstanding standards, floor supports interfitting with said standards, said standards having slots which interfit with slots in said floor supports, said standards having a plurality of steps, at least one of said shelves being formed by mounting a panel on to a step of the standard, said floor supports having a plurality of flaps which have slots therein, the slots interfitting with slots in the bottoms and sides of the standards, said floor supports having inner flaps and outer flaps, said floor supports having vertical slots and horizontal slots, inner flaps of the floor supports interfitting with the vertical slots, and the horizontal slots interfitting with the end flaps, and the outer flaps of the floor supports interfitting with slots in the front of the standards to form a lower shelf member.

2. A display stand as claimed in claim 1 wherein three floor supports are provided with the inner flaps of the outer supports and both flaps of the central support interfitting with the lower vertical slots.

3. A display stand as claimed in claim 2 wherein said standard includes a front portion between the steps and wherein a juncture slot is provided at the juncture of a step and its associated front portion.

4. A display stand as claimed in claim 3 wherein a shelf is formed by a plurality of panels having flaps, the flaps interfitting with said juncture slot.

5. A display stand as claimed in claim 4 wherein the front panel of one of said steps lies along the front portion and interfits wth the slot on the bottom thereof and wherein the horizontal panel has a flap which interfits at the juncture slot adjacent the step.

6. A display stand as claimed in claim 5 wherein the standard has a nose portion with a slot directly therebeneath.

7. A display stand as claimed in claim 6 wherein the upper shelf is formed by a pair of panels wrapped around said nose portion, the end of the panels having slots with one slot interfitting with the slot beneath the nose and the other slot interfitting with the rear portion of the nose.

8. A display stand as claimed in claim 7 wherein side elements are mounted, said slide elements having support means insertable in panels forming the steps.

9. A display stand as claimed in claim 8 wherein said supports have lock fingers extending rearwardly and wherein said side panels have a rear support with slots insertable therein.

10. A display stand as claimed in claim 9 wherein a display panel is mounted on the fingers.

11. A display stand as claimed in claim 10 wherein a strap is mounted on the fingers.

12. A display stand as claimed in claim 11 wherein a panel is mounted on said lower shelf member.

13. A display stand as claimed in claim 12 wherein the front of said supports has another horizontal slot and another panel is inserted therein to form a shelf above the lower shelf member.

* * * * *